US007216841B2

(12) United States Patent
Dodig, Jr.

(10) Patent No.: US 7,216,841 B2
(45) Date of Patent: May 15, 2007

(54) METHOD AND APPARATUS FOR HANGING PICTURES AND OTHER WALL OBJECTS

(76) Inventor: John M. Dodig, Jr., 42 Gillies La., Norwalk, CT (US) 06854

( * ) Notice: Subject to any disclaimer, the term of this patent is extended or adjusted under 35 U.S.C. 154(b) by 0 days.

(21) Appl. No.: 11/103,006

(22) Filed: Apr. 11, 2005

(65) Prior Publication Data

US 2005/0178942 A1 Aug. 18, 2005

Related U.S. Application Data

(63) Continuation-in-part of application No. 10/746,823, filed on Dec. 24, 2003, now abandoned, which is a continuation-in-part of application No. 10/285,923, filed on Nov. 1, 2002, now abandoned.

(51) Int. Cl.
*A47G 1/16* (2006.01)

(52) U.S. Cl. ..... 248/475.1; 248/489

(58) Field of Classification Search ..... 248/475.1, 248/493, 497, 546, 498, 489; D6/367, 354
See application file for complete search history.

(56) References Cited

U.S. PATENT DOCUMENTS 2,990,065 A * 6/1961 Margulis ..... 211/106.01
3,226,065 A * 12/1965 Smith ..... 248/493
3,955,790 A * 5/1976 Ballin ..... 248/489
4,871,140 A * 10/1989 Hoskinson et al. ..... 248/496
5,069,412 A * 12/1991 Jacob ..... 248/493
5,103,573 A * 4/1992 Ehling et al. ..... 33/613
5,209,444 A * 5/1993 Rinderer ..... 248/205.1
5,209,449 A * 5/1993 Hart ..... 248/475.1
5,437,429 A * 8/1995 Atlas ..... 248/493
5,758,858 A * 6/1998 Barnes ..... 248/544
5,921,518 A * 7/1999 Bernardi ..... 248/304
6,193,207 B1 * 2/2001 Umberg ..... 248/551
6,241,210 B1 * 6/2001 Brindisi ..... 248/476
6,245,177 B1 * 6/2001 Luhmann ..... 156/182
6,286,802 B1 * 9/2001 Munson et al. ..... 248/475.1
6,641,107 B1 * 11/2003 Janssen ..... 248/493

* cited by examiner

*Primary Examiner*—Ramon O Ramirez
(74) *Attorney, Agent, or Firm*—Grimes & Battersby, LLP

(57) ABSTRACT

A fastening device is provided for hanging a picture or other wall object on a wall. The fastening device includes a clear, flexible, non-resilient carrier having at least two mounting hooks in parallel alignment which are secured to the carrier for engaging wire mounting means on the back of the picture or wall object. This permits the device to be used on irregularly shaped or curved walls or walls with imperfections. Alignment grooves may be provided at opposite ends of the carrier to facilitate proper alignment of the carrier on the wall. Affixation means in the form of either a nail or adhesive mounts are provided for affixing the carrier to the wall. A leveling device, preferably a bubble level, may be included in the carrier. A companion method for hanging the picture or other wall object on a wall using the subject fastening device is further provided. The leveling device may be removably attached to the carrier by means of a snap or compression fit within a concavity or depression in the carrier to thereby allow repeated uses of the same leveling device.

2 Claims, 2 Drawing Sheets

METHOD AND APPARATUS FOR HANGING PICTURES AND OTHER WALL OBJECTS

RELATED APPLICATION

This is a continuation-in-part application of application Ser. No. 10/746,823 filed on Dec. 24, 2003 entitled "Method and Apparatus for Hanging Pictures and Other Wall Objects," which, in turn, was a continuation-in-part application of then application Ser. No. 10/285,923 filed on Nov. 1, 2002 entitled "Method and Apparatus for Hanging Pictures and Other Wall Objects" both abandoned.

BACKGROUND OF THE INVENTION

1. Field of the Invention

The present invention relates generally to method and apparatus for hanging pictures and other wall objects on a wall and, more particularly, to a fastening device for hanging such pictures and other wall objects that can quickly and easily facilitate the level hanging of the picture or other object on the wall.

2. Description of the Prior Art

Since time in memoriam, people have been hanging pictures and other objects on walls, initially using nails and subsequently more sophisticated picture hangers. Typically, this is accomplished by the use of one or more picture hangers that are inserted into the wall which are adapted to engage a wire on the back of a picture or other object in order to secure it to the wall. These picture hangers are frequently of the type having an upper portion which issued includes an aperture through which a nail may be inserted for attaching the hanger to the wall and a lower portion which includes a hook for engaging the wire on the back of the picture.

While one hook or fastening device can adequately secure a picture or other object to a wall, it is preferable to use at least two hooks or fastening devices to insure that the picture or object which is being hung is adequately secured to the wall and maintained in proper alignment.

The prior art is replete with examples of fastening devices or hooks which come in a variety of different shapes, sizes and configurations. See, for example, U.S. Pat. No. 4,241,510 which issued on Dec. 30, 1980 to R. P. Radecki for Aid for Hanging Pictures; U.S. Pat. No. 4,384,648 which issued on May 24, 1983 to L. Hart et al. for Easy Mount Picture Package; U.S. Pat. No. 4,712,761 which issued on Dec. 15, 1987 to E. T. Wassell for Picture Hanging Assembly; U.S. Pat. No. 5,303,895 which issued on Apr. 19, 1994 to H. E. Hart for Apparatuses and Methods for Hanging Frames; U.S. Pat. No. 5,471,760 which issued on Dec. 5, 1995 to D. R. Farris for Picture Frame Locator; U.S. Pat. No. 5,509,213 which issued on Apr. 23, 1996 to M. H. Kelly et al. for Picture Frame Hanger Aid and Aligning Device; and U.S. Pat. No. 4,867,917 which issued on Feb. 9, 1999 to D. R. Karon for Picture Frame Locating Device.

Similarly, the incorporation of a leveling device, preferably a bubble leveling device in such a fastening device is also well known. See, for example, U.S. Pat. No. 4,100,681 which issued on Jul. 18, 1978 to B. L. Hollander for Picture Frame Leveling Device; U.S. Pat. No. 4,208,802 which issued on Jun. 24, 1980 to S. R. Berndt for Level Indicating Device for Wall-Mounted Pictures; U.S. Pat. No. 4,473,957 which issued on Oct. 2, 1984 to R. E. Falukner for Device for Locating a Frame Hanger; U.S. Pat. No. 4,648,185 which issued on Mar. 10, 1987 to U. L. Brandimarte for Leveling Tool; U.S. Pat. No. 4,944,094 which issued on Jul. 31, 1990 to J. G. Depiano et al. for Picture Frame Leveling Tool; U.S. Pat. No. 5,103,574 which issued on Apr. 14, 1992 to K. K. Levy for Measuring Tool for Hanging Up Pictures and the Like; U.S. Pat. No. 5,451,027 which issued on Sep. 19, 1995 to R. McHenry for Picture Hanging Device; U.S. Pat. No. 5,463,817 which issued on Nov. 7, 1995 to R. A. Leeds for Picture Frame Leveling Device; U.S. Pat. No. 5,802,729 which issued on Sep. 8, 1998 to P. D. O'Brien et al. for Apparatus for Assisting in Positioning Hanging Articles; U.S. Pat. No. 6,092,362 which issued on Feb. 29, 2000 for Alignment Device; U.S. Pat. No. 6,138,369 which issued on Oct. 31, 2000 to U. Mushin for Level Indicator for a Wall-Mounted Fixture; U.S. Pat. No. 6,205,669 which issued on Mar. 27, 2001 for Wall Hanging Level; U.S. Pat. No. 6,257,151 which issued on S. Hale on Jul. 10, 2001 for Shelving Unit With Internal Leveling Indicator; U.S. Pat. No. 6,286,802 which issued on Sep. 11, 2001 to L. C. Munson for Hanger System having Bubble Level Insert; and U.S. Pat. No. 6,305,093 which issued on Oct. 23, 2001 for Hanger Tool To Facilitate Centering And Hanging Of A Component.

While each of these patents disclose a form of fastening device, some with leveling means, all are extremely complicated, expensive, and frequently difficult to actually use. This is in stark contrast with the fastening device of the present invention which simply and inexpensively permits the secure and level hanging of a picture with no training and at a fraction of the cost of many of these devices.

SUMMARY OF THE INVENTION

Against the foregoing background, it is a primary object of the present invention to provide a fastening device for hanging a picture or object on a wall.

It is another object of the present invention to provide such a fastening device which is easy to use and inexpensive to manufacture.

It is yet another object of the present invention to provide such a fastening device that may also include automatic leveling means.

It is still another object of the present invention to provide such a fastening device wherein the automatic leveling means maybe removably attached to the device to thereby allow the automatic leveling means to be used repeatedly each time a fastening device is used.

To the accomplishments of the foregoing objects and advantages, the present invention, in brief summary, comprises a fastening device for hanging a picture or other wall object on a wall. The fastening device including a carrier having at least two mounting hooks in parallel alignment which are secured to the carrier for engaging wire mounting means on the back of the picture or wall object. Affixation means in the form of either a nail or adhesive mounts are provided for affixing the carrier to the wall. A leveling device, preferably a bubble level, may be included in the carrier. A companion method for hanging the picture or other wall object on a wall using the subject fastening device is further provided. In the preferred embodiment, the leveling device is removably attached to the carrier by means of a snap or compression fit within a concavity or depression in the carrier.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
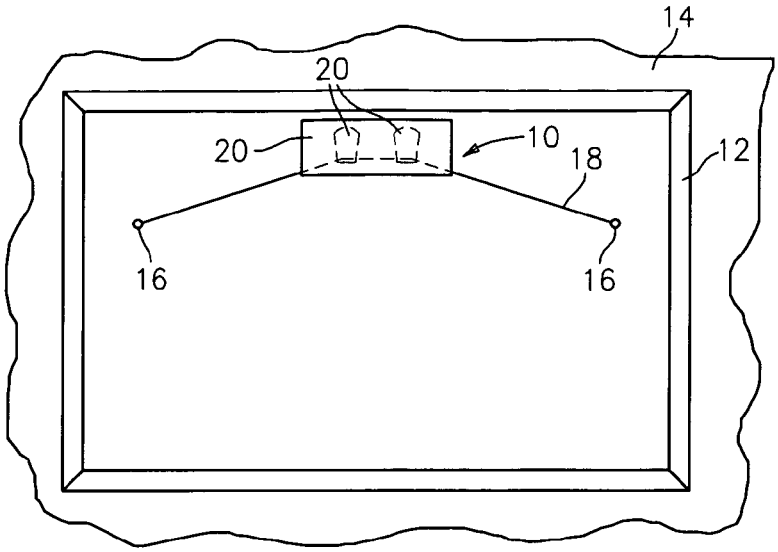
FIG. 1 is a rear view through a wall showing the manner in which the fastening device of the present invention is used to hang a picture on the wall.
Figure 2:
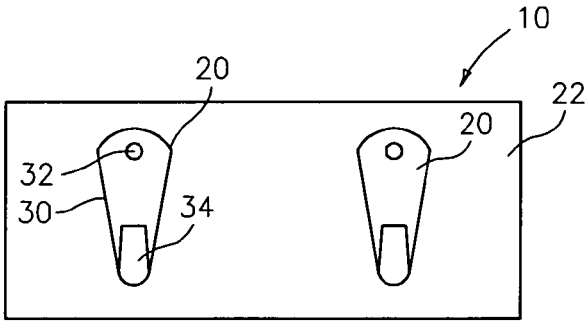
FIG. 2 is a front view of the fastening device of the present invention.
Figure 3:
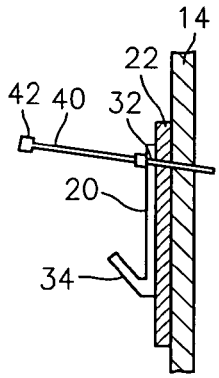
FIG. 3 is a side view of the fastening device of FIG. 2.

Referring to the drawings and, in particular, to FIGS. 1–3 thereof, the fastening device of the present invention, referred to generally by reference numeral 10, is illustrated as it may be used in actually attaching a picture 12 to a wall 14. The picture 12 being attached is the type having a pair of eyelets 16 and a wire 18 attached to both eyelets to permit hanging of the picture using any fastening device including the fastening device 10 of the present invention. The fastening device 10 of the present invention includes a pair of fastening hooks 20 which are mounted on or secured to a mounting carrier 22, preferably by an adhesive or glue.

As better shown in FIGS. 2 and 3, the fastening hooks 20 are conventional picture hanger hooks 20 of the type having a substantially flat back portion 30 include an aperture 32 contained in the upper portion of the back portion 30 and a raised retaining or hook portion 34 which serves to engage and capture the wire 18 on the back of the picture or wall object 12 (see FIG. 1). A nail or fastening element 40 having an enlarged head 42 is provided and is adapted to pass through the aperture 32 contained in the hook 20.

Mounting carrier 22 can be fabricated from a flexible, non-resilient, plastic or cardboard material and hooks 20 are secured to the carrier 22 by a conventional adhesive material. In a preferred embodiment, the carrier is clear so that the user can visually see any imperfections in the wall. It is important that the mounting carrier 22 be relatively soft and pliable to permit the nail 40 to be easily driven through the carrier 22 with simple pressure. Similarly, the carrier should be non-resilient so as to permit conformity to the wall and any imperfections thereon. Flexibility of the carrier further permits the mounting carrier 22 to be used on walls with irregular surfaces or on curved walls since the flexibility of the carrier will accommodate the irregularity of the surfaces or the curve of the walls or any imperfections thereon.

Each of the ends of the carrier 22 include alignment V-shaped grooves 22A which assist the user in properly aligning the carrier on the wall. For example, the user can mark a line on the wall where they want to mount the picture. The marked line would be visible through the clear carrier 22 which can be perfectly aligned by aligning the marked line with the alignment V-shaped grooves 22A at the ends of the carrier 22.

It will be appreciated that the fastening device 10 can come in a variety of different sizes depending upon the size of the picture to be hung and the size of the carrier 22 will vary in length depending upon the ultimate size of the device 10. The most common size will be approximately three inches long which should accommodate most pictures. As the art object gets bigger, however, the size of the device will increase proportionally.

It will be appreciated that while the drawings all depict a pair of hooks 20 mounted on a single carrier 22, there may be instances where it is necessary to use more than two hooks 20, e.g., where the weight of the picture or object is such as to require greater support. Similarly, there may be instances in which one cannot use a nail 40 to penetrate the wall 14. In such instances, the nail 40 may be eliminated and a releasable adhesive means (not shown) is attached to the rear of the carrier 22 for securing the carrier to the wall 14.

As shown perhaps best in FIG. 3, the fastening device 10 of the present invention is employed by positioning the carrier 22 on the wall 14 in an appropriate position. The clear nature of the carrier 22 permits the device to accommodate irregularities on the wall and be used with curved and irregularly shaped walls. The user may first want to place a line of the wall before mounting the device which is visible through the clear carrier and then aligned with the alignment grooves 22A at the end of the carrier 22. It is secured to the wall by driving the nail 40 through the hook 20 and the carrier 22 into the wall using a hammer or other driving tool. After both nails 40 are driven into the wall 14, the picture may be hung by securing the wire 18 to the hook portion 34 of the hooks 20.

Figure 4:
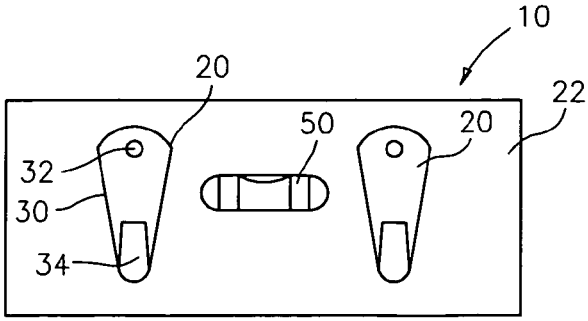
FIG. 4 is a front view of an alternative embodiment of the fastening device of the present invention.
Figure 5:
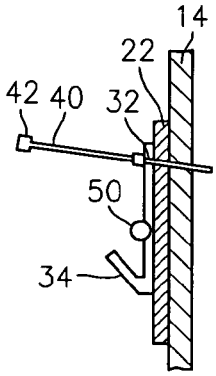
FIG. 5 is a side view of the fastening device of FIG. 4.

FIGS. 4 and 5 depict an alternative embodiment of the present invention where a leveling device 50 is incorporated into the carrier 22. The leveling device 50 can be virtually any type of leveling device but a particularly preferred device is a bubble level as depicted in the drawings due to the inexpensive cost and facility of use. In such a manner, the user would check the leveling 50 prior to securing the carrier 22 to the wall 14 to insure that the device 10 and both hooks 20 mounted thereon are level. This will insure that any picture or wall object mounted using the device of the present invention is similarly level.

Figure 6:
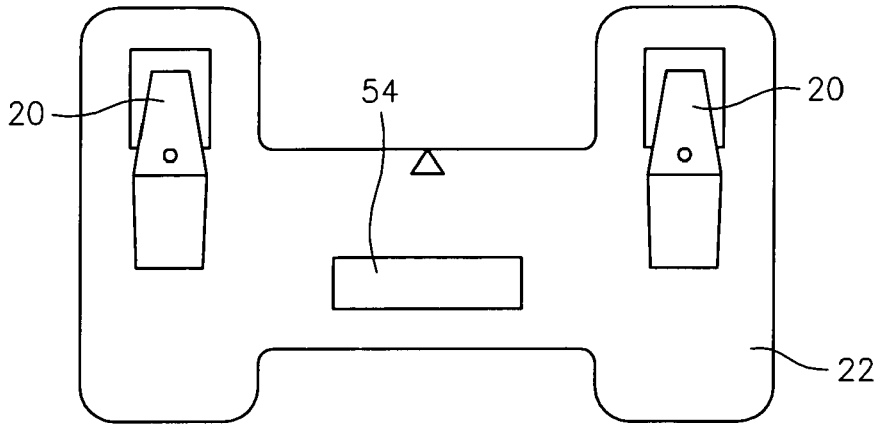
FIG. 6 is a front view of another alternative embodiment of the fastening device of the present invention.
Figure 7:
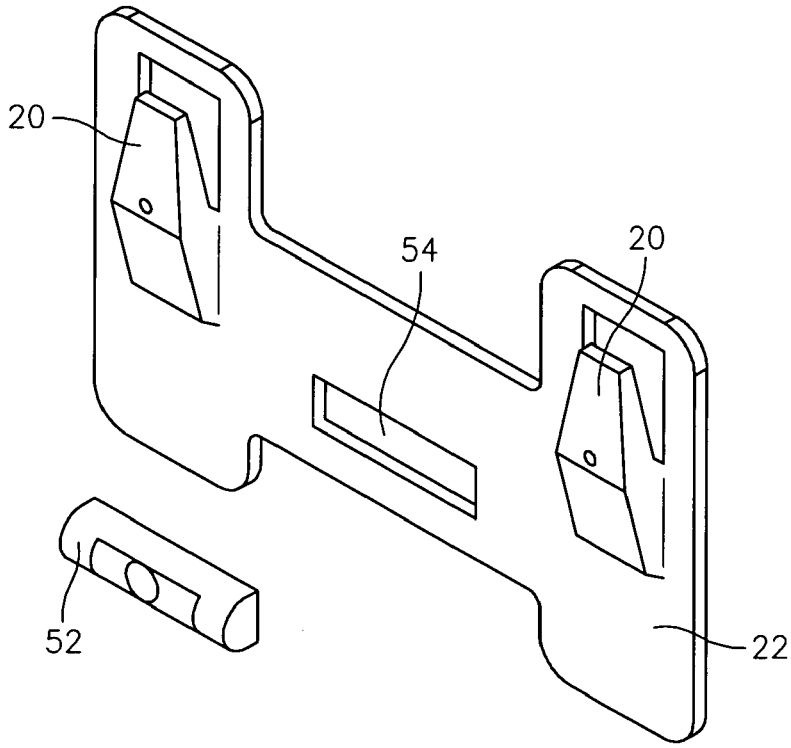
FIG. 7 is a perspective view of the fastening device of FIG. 6.

Illustrated in FIGS. 6 and 7 is another alternative embodiment of the present invention in which a removable level 52 is provided in place of the fixed leveling device 50. In the preferred embodiment, the removable level 52 is a bubble level due to the inexpensive cost and facility of use. However, inasmuch as in this embodiment a user may repeatedly use the removable level 52 for multiple installations, a more expensive and accurate leveling device may be used. A depression 54 is provided within the surface of the carrier 22, which depression 54 corresponds in size and shape to a portion of the removable level 52 such that the removable level 52 may be inserted within the depression 54 and retained therein by means of a compression or snap fit. Of course, other methods of attachment would be as effective, including the use of a temporary adhesive or means for sliding the temporary level 52 in place. The primary concern, however, is that the removable level 52 is aligned with the hooks such that the removable level 52 functions to ensure the device 10 is indeed level. In this embodiment, the entire device 10 but for the removable level 52 may be constructed out of a single piece of material, such as plastic or metal, so as to facilitate the manufacture and installation of the device 10. It should be appreciated that by allowing the removal of the removable leveling device 52, this feature will not project from the device 10 or otherwise interfere or come into contact with the picture 12.

Having thus described the invention with particular reference to the preferred forms thereof, it will be obvious that various changes and modifications can be made therein without departing from the spirit and scope of the present invention as defined by the appended claims.

I claim:

1. A fastening device for hanging a picture or other wall object on a wall, said device including:

a removal leveling device comprising a bubble level;

a soft and pliable carrier fabricated from a clear, flexible and non-resilient plastic material so as to permit a user to visually observe any imperfections in wall and permit the carrier to conform to the wall and any imperfections therein, said carrier also including a v-shaped alignment groove at each end thereof to facilitate proper alignment of the carrier on the wall and a depression therein having a size and shape corresponding to the size and shape of said removable leveling device so as to permit said leveling device to be snapped into and out of said depression so as to releasably secure said leveling device within said carrier;

at least two mounting hooks in parallel alignment secured to said carrier by an adhesive for engaging wire mounting means on the back of said picture or wall object; and affixation means for affixing said carrier to the wall, said affixation means comprising at least one nail which can be driven through said at least one mounting hooks and said carrier.

2. A method for hanging a picture or other wall object on a wall, said method comprising the steps of:

providing a fastening device of the type including:

a removal leveling device comprising a bubble level;

a soft and pliable carrier fabricated from a clear, flexible and non-resilient plastic material so as to permit a user to visually observe any imperfections in wall and permit the carrier to conform to the wall and any imperfections therein, said carrier also including a v-shaped alignment groove at each end thereof to facilitate proper alignment of the carrier on the wall and a depression therein having a size and shape corresponding to the size and shape of said removable leveling device for releasably securing said leveling device;

at least two mounting hooks in parallel alignment secured to said soft and pliable carrier by an adhesive for engaging wire mounting means on the back of said picture or wall object;

affixation means for affixing said soft and pliable carrier to the wall, said affixation means comprising at least one nail which can be driven through said at least one mounting hooks and said carrier; and snapping said removable leveling device into said depression so as to releasably secure said leveling device within said depression;

positioning the pliable carrier on the wall such that the v-shaped alignment grooves are aligned with any mark placed on the wall and the leveling means indicating that the pliable carrier is level;

affixing said pliable carrier to said wall;

removing said removable leveling device from said depression; and mounting said picture or other wall object onto said fastening device by engaging the wire mounting means on the back of the picture or wall object with the mounting hooks on said pliable carrier.

* * * * *